US010156115B2

(12) United States Patent
Irvine et al.

(10) Patent No.: US 10,156,115 B2
(45) Date of Patent: Dec. 18, 2018

(54) WEIGHT SET MANDREL AND TUBING HANGER

(71) Applicants: Jock W. Irvine, Houston, TX (US); Thomas M. Lambert, Houston, TX (US)

(72) Inventors: Jock W. Irvine, Houston, TX (US); Thomas M. Lambert, Houston, TX (US)

(73) Assignee: CONTROL FLOW, INC., Houston, TX (US)

( * ) Notice: Subject to any disclaimer, the term of this patent is extended or adjusted under 35 U.S.C. 154(b) by 133 days.

(21) Appl. No.: 15/257,700

(22) Filed: Sep. 6, 2016

(65) Prior Publication Data

US 2017/0067307 A1 Mar. 9, 2017

Related U.S. Application Data

(60) Provisional application No. 62/214,754, filed on Sep. 4, 2015.

(51) Int. Cl.
*E21B 33/04* (2006.01)
*E21B 23/01* (2006.01)

(52) U.S. Cl.
CPC ..... *E21B 33/04* (2013.01); *E21B 23/01* (2013.01)

(58) Field of Classification Search
CPC ..... E21B 33/04; E21B 23/01
USPC ..... 166/382
See application file for complete search history.

(56) References Cited

U.S. PATENT DOCUMENTS

| | | | | |
|---|---|---|---|---|
| 4,421,164 | A * | 12/1983 | Galle, Jr. | E21B 33/04 166/118 |
| 4,836,288 | A * | 6/1989 | Wester | E21B 33/043 166/340 |
| 6,241,023 | B1 * | 6/2001 | Krauss | E21B 23/06 166/125 |
| 2005/0023866 | A1 * | 2/2005 | Matusek | E21B 23/04 296/210 |
| 2008/0135229 | A1 * | 6/2008 | Hunter | E21B 33/04 166/84.1 |
| 2014/0262349 | A1 * | 9/2014 | Turley | E21B 23/06 166/387 |

* cited by examiner

*Primary Examiner* — Taras P Bemko

(57) ABSTRACT

An improved weight-set hanger system and method of securing the weight set hanger for use comprises three independent locking mechanisms that are built into an actuator/packoff assembly. These independent locking mechanisms comprise two locking rings, one of which fastens the actuator/packoff assembly to a spool body, and the other of which internally locks the hanger to the actuator/packoff assembly. A third locking mechanism comprises a plurality of screw down spring loaded lock pin assemblies, which, in an embodiment, are spaced out at 90 degree intervals.

10 Claims, 2 Drawing Sheets

WEIGHT SET MANDREL AND TUBING HANGER

CROSS REFERENCE TO RELATED APPLICATIONS

The present application is a non-provisional application that claims the benefit and priority from Provisional U.S. Patent Application No. 62/214,754, filed Sep. 4, 2015, titled "Weight-Set Mandrel and Tubing Hanger," which is incorporated in its entirety herein by reference.

FIELD

Embodiments usable within the scope of the present disclosure relate, generally, to a simplified weight-set hanger system requiring no manual intervention.

BACKGROUND

It is common in the oil & gas industry for casing and tubing hangers to depend upon the installation of threaded connections, such as lockdown screws and/or threaded locking rings.

However, these connections often require painstaking manual intervention, and the use of threaded connections limits the stability. For instance, threaded connections often require rotation of the packoff assembly, which introduces a chance for wellhead seals to be damaged. Additionally, these threaded parts must be replaced often due to wear and tear, which can raise the cost of wellhead operations.

A need exists for a simplified system that can lock a casing or tubing hanger off a wellhead without the use of threaded lockdown screws, while minimizing rotation of lock rings, and still providing the needed stability and ease of maintenance.

Embodiments of the apparatus described herein meet this and other needs.

BRIEF DESCRIPTION OF THE DRAWINGS

In the detailed description of the embodiments, presented below, reference is made to the accompanying drawings.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
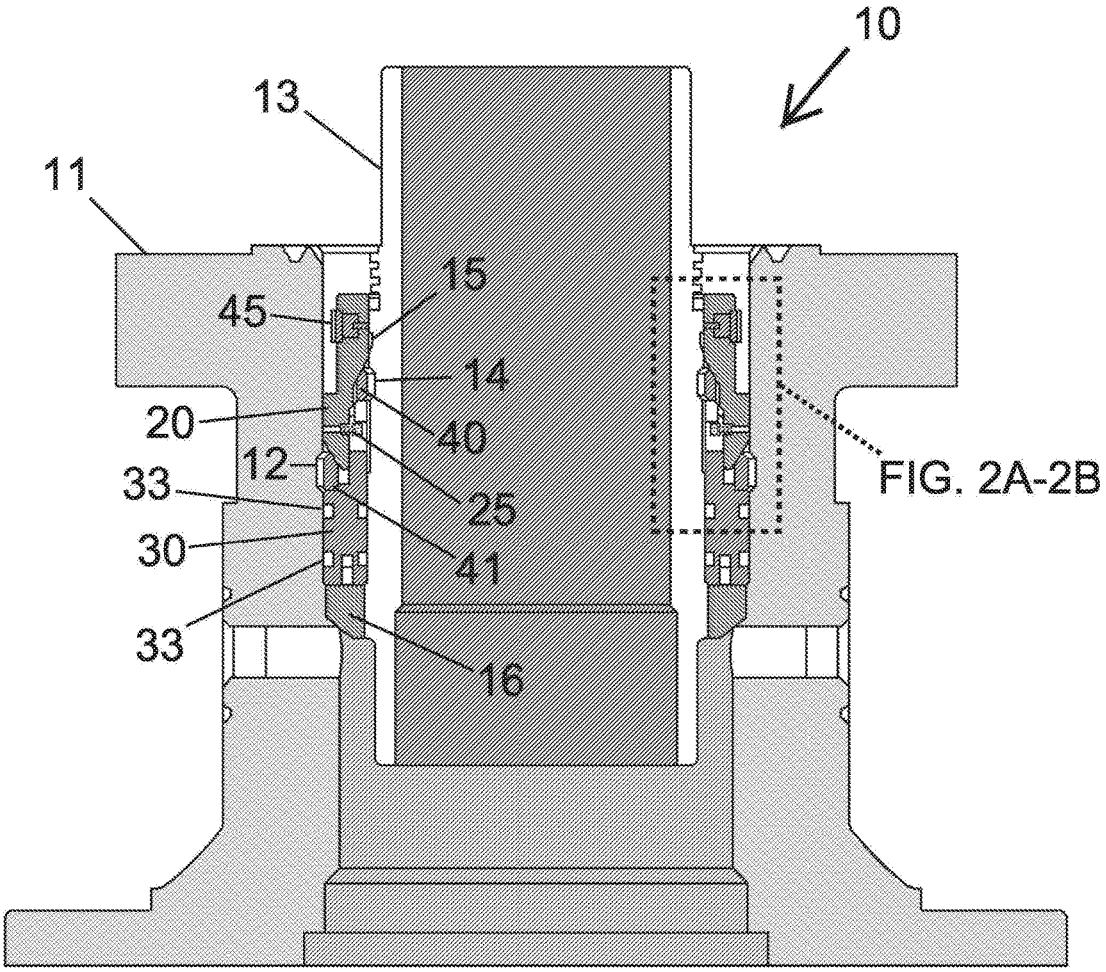
FIG. 1 depicts an overall cross-section view of the actuator packoff assembly.

Referring to FIG. 1, the depicted embodiment of the invention comprises three separate locking devices built into a single actuator/packoff assembly 10. Actuator/packoff assembly 10 comprises an actuator ring 20 located above packoff body 30, as well as an upper lock ring 40, a lower lock ring 41, and a plurality of screw dog spring loaded lock pin assemblies 45. While the embodiment is depicted with two such lock pin assemblies 45 visible in cross-section, it should be noted that the depicted embodiment also comprises two additional lock pin assemblies 45 (not visible in cross-section), with a total of four arranged at 90 degree intervals. Screw dog spring loaded lock pin assemblies 45 can act as both spring loaded lock pin assemblies and screw dog pins for running and retrieval of the actuator packoff assembly 10. (For simplicity, FIG. 1 is numbered only on one side; numbers are duplicated as visible in FIG. 2A-2B.)

As shown, actuator/packoff assembly 10 can be positioned between the outer diameter of a hanger 13 and an inner diameter of a spool body 11 (which may be a casing spool body or a tubing spool body). As further shown in the depicted embodiment, spool body 11 can comprise at least one locking groove 12, which can be positioned around the inner diameter of the spool body 11, while hanger 13 can comprise two locking grooves 14, 15, which can be positioned along the outer diameter thereof. Hanger 13 may be a tubing hanger, a fluted mandrel casing hanger, or any other suitable hanger, provided that two locking grooves 14, 15 are present on the hanger outer diameter.

As shown, upper lock ring 40 can be positioned on the first shoulder 31 (identified in FIG. 2A-2B) of the packoff body 30 next to an angled face 21 (identified in FIG. 2A-2B) of the actuator ring 20. Upper lock ring 40 is expandable upon the application of pressure, at which point upper lock ring 40 can be captured by locking groove 14 of hanger 13. Lower lock ring 41, as shown, can be expandable and positioned along a second shoulder 32 (identified in FIG. 2A-2B) of the packoff body 30 and a second angled face 22 (identified in FIG. 2A-2B) of actuator ring 20, and can be captured into position by locking groove 12 of spool body 11. In an embodiment, the first locking ring can provide a ninety percent (90%) circumferential lock, while the second locking ring can provide a ninety-five percent (95%) circumferential lock. However, other embodiments may provide more or less circumferential coverage, as necessitated by well conditions. Lock pin assemblies 45, as shown, can be captured by locking groove 15 of hanger 13. Packoff ring 30 is fitted with a plurality of s-seals 33 for sealing against both the spool body 11 and the hanger 13.

Prior to use, packoff body 30 and actuator ring 20 can be assembled together and held in the unlocked position by attachment shear pins (not shown). A plurality of alignment screws 25 can be screwed into actuator ring 20 through machined slots 34 within packoff body 30 to ensure alignment during running and retrieval. It should be appreciated that in this embodiment, these machined slots 34 are shown in this particular cross-section, but do not extend concentrically around the packoff assembly 30. Thus, packoff assembly 30 and first shoulder 31 appear to be separate components in this diagram but are actually parts of the same component.

Figure 2B:
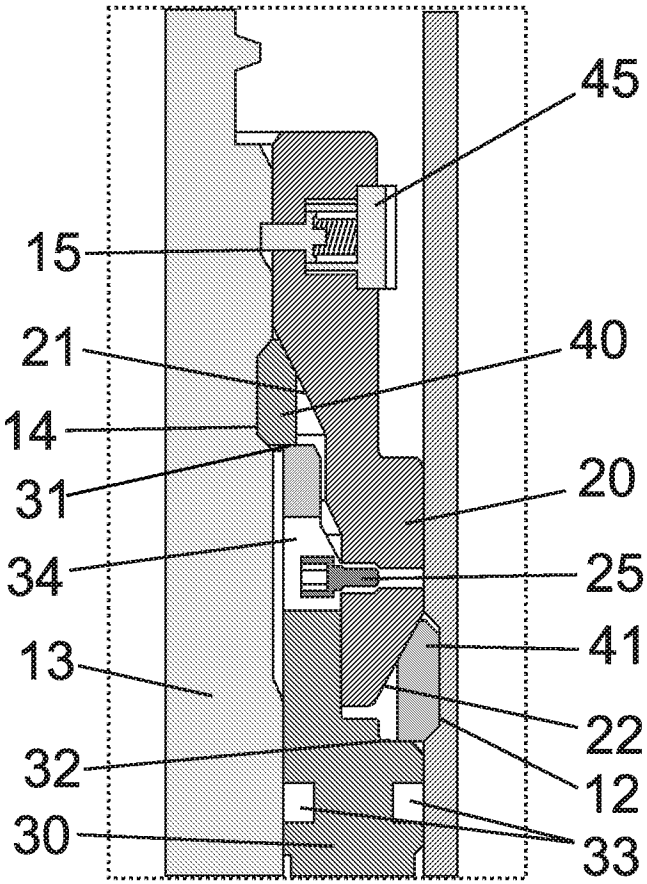
FIG. 2B depicts a zoomed in view of the packoff ring assembly and the actuator ring assembly in the locked position.
Figure 2A:
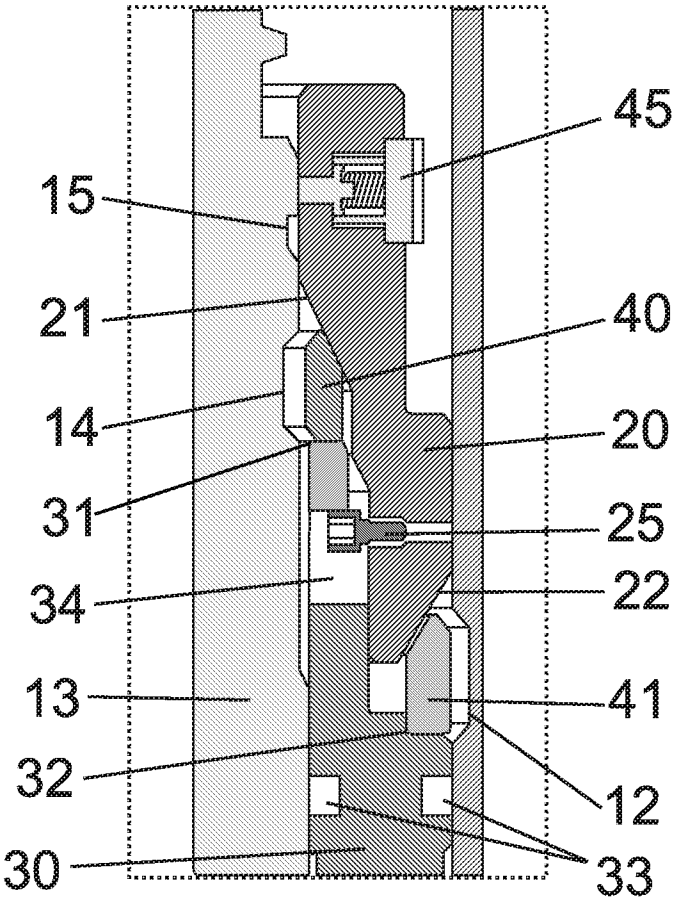
FIG. 2A depicts a zoomed-in view of the packoff ring assembly and the actuator ring assembly in the unlocked position.

Referring now to FIGS. 2A and 2B, the use of the actuator/packoff assembly 10 is illustrated in practice. Actuator/packoff assembly 10 can be run into position by industry standard running and retrieval tools that can, for example, utilize a J-slot type function that can be aligned with the screw dog spring loaded lock pin assemblies 45. As shown, actuator/packoff assembly 10 lands on the shoulder 16 (shown in FIG. 1) of hanger 13, which can rest on an inner diameter of the spool body 11. FIG. 2A depicts the actuator-pack off assembly 10 in an unlocked position for running/retrieval.

Once landed, the full weight of the tubing/casing string can be loaded onto the running and retrieval tool, which results in an downward stabbing force shearing the two attachment shear pins (not shown), and a downward force being applied onto the actuator/packoff assembly 10, which pushes the actuator ring 20 down towards the packoff body 30, which is braced against a shoulder 16 of the hanger 13. It can be seen that the respective angled faces 21, 22 of the actuator ring 20 can act to force the respective locking rings 40, 41 away from the actuator ring, into respective grooves 14, 12 of respective hanger 13 and spool body 11. Lock pin assemblies 45, such as screw dog spring loaded lock pin assemblies 45, can then spring out from the J-slot and lock into groove 15 of hanger 13.

FIG. 2B depicts the actuator/packoff assembly 10 in its locked state with the attachment shear pins (not shown) sheared, and actuator ring 20 lowered by the stabbing force with respect to packoff body 30. The running/retrieval tool can then be rotated to release the actuator/packoff assembly 10 and withdrawn.

During retrieval, the running/retrieval tool can interface with the screw dog spring loaded lock pin assemblies 45, which can be aligned with a J-slot (or other suitable retrieval mechanism) and pulled upwards with an over-pull (e.g., in an embodiment, this over-pull force can be roughly equal to 20,000 lbs or 9,000 kg). This action can shear the screw dog spring loaded lock pin assemblies 45, separate the actuator ring 20 from the packoff body 30, and allow the locking rings 40, 41 to withdraw from their respective grooves 14, 12.

The design described herein yields several advantages over existing hanger assemblies. As there is no rotation of the actuator/packoff assembly itself, only the running and retrieval tool, the chances of seal damage are minimized while ensuring that the hanger remains safely locked during tubing and casing running operations. Installation and retrieval requires little or no maintenance or manual intervention, and the cost of replacement parts amounts to, in a preferred embodiment, a total of six shear pins (i.e., two on running being sheared by push force and four on retrieval being sheared by over-pull).

Although several preferred embodiments of the invention have been illustrated in the accompanying drawings and described in the foregoing specification, it will be understood by those of skill in the art that additional embodiments, modifications and alterations may be constructed from the invention principles disclosed herein, while still falling within the scope of the disclosed invention.

The invention claimed is:

1. A weight set hanger system comprising:

a hanger comprising a hanger shoulder;

a rotationally fixed packoff body resting on the hanger shoulder, the rotationally fixed packoff body comprising a first load shoulder, a second load shoulder, and a plurality of seals;

a first expandable locking ring positioned on the first load shoulder and projecting outward;

a second expandable locking ring positioned on the second load shoulder and projecting inward; and an actuating ring located over the packoff body and first and second locking rings and comprising a first angled face, a second angled face, and a plurality of shearable lock pins;

wherein the actuating ring transmits a pressure to the rotationally fixed packoff body, wherein the first load shoulder and the first angled face force the first expandable locking ring to expand outward, wherein the second load shoulder and the second angled face force the second expandable locking ring to expand inward, wherein the plurality of shearable lock pins force the packoff body into place against the hanger, and wherein the plurality of seals seal against the hanger.

2. The weight set hanger system of claim 1, wherein the rotationally fixed packoff body further comprises a plurality of alignment slots.

3. The weight set hanger system of claim 2, wherein the actuator ring further comprises a plurality of alignment protrusions corresponding with the plurality of alignment slots.

4. The weight set hanger system of claim 1, wherein the plurality of shearable lock pins are spring loaded.

5. The weight set hanger system of claim 4, further comprising a spool body concentrically surrounding the hanger and rotationally fixed packoff body.

6. The weight set hanger system of claim 5, wherein the spool body comprises a first groove along the inner diameter thereof.

7. The weight set hanger system of claim 6, wherein the first expandable locking ring expands into the first groove.

8. The weight set hanger system of claim 6, wherein the hanger further comprises a second groove along the outer diameter thereof, and a plurality of slots along the outer diameter thereof.

9. The weight set hanger system of claim 8, wherein the second expandable locking ring expands into the second groove, and wherein the plurality of shearable lock pins lock into the plurality of slots.

10. The weight set hanger system of claim 5, wherein the plurality of seals additionally seal against the spool body.

* * * * *